US006089471A

United States Patent [19]

Scholl

[11] Patent Number: 6,089,471

[45] Date of Patent: Jul. 18, 2000

[54] FLUID SPRAY GUN

[75] Inventor: Charles T. Scholl, Shaker Heights, Ohio

[73] Assignee: Accuspray, Inc., Cleveland, Ohio

[21] Appl. No.: 09/047,882

[22] Filed: Mar. 25, 1998

[51] Int. Cl.[7] ..... B05B 1/26; B05B 1/30

[52] U.S. Cl. ..... 239/300; 239/416.2; 239/416.4; 239/417.3

[58] Field of Search ..... 239/300, 296, 239/290, 416.2, 416.4, 417.3

[56] References Cited

U.S. PATENT DOCUMENTS

| | | | |
|---|---|---|---|
| 2,559,407 | 7/1951 | Dalrymple | 239/300 X |
| 2,843,425 | 7/1958 | Paasche | 239/300 |
| 4,713,257 | 12/1987 | Luttermoller | 239/296 X |
| 4,759,502 | 7/1988 | Pomponi et al. | 239/300 X |
| 4,915,303 | 4/1990 | Hufgard . | |
| 4,948,053 | 8/1990 | Hufgard . | |
| 4,993,642 | 2/1991 | Hufgard | 239/300 |
| 5,178,330 | 1/1993 | Rodgers | 239/300 |
| 5,180,104 | 1/1993 | Mellete | 239/300 |
| 5,695,120 | 12/1997 | Kingsford . | |
| 5,695,125 | 12/1997 | Kumar . | |

*Primary Examiner*—Kevin Weldon

*Attorney, Agent, or Firm*—Fay, Sharpe, Fagan, Minnich & McKee, LLP

[57] ABSTRACT

A high volume, low pressure spray gun for use with air atomizable liquids includes a gun handle and a gun barrel. A plenum is defined in the gun barrel. A valve seat defined in the gun barrel communicates with the plenum. A supply air inlet in the plenum feeds supply air into the plenum. An aperture in the plenum directs air flow out of the plenum. A first outlet defined in a wall of the aperture directs fan air flow out of the aperture and a second outlet defined in the wall of the aperture directs atomizing air flow out of the aperture. A third outlet, which is located in the plenum, directs atomizing air flow out of the plenum. The third outlet is located on one side of the valve seat and the second outlet is located on the other side of the valve seat. With this construction, the valve may selectively close one of these outlets and restrict atomizing air flow out of the plenum. At the same time, fan air flow is shut off.

21 Claims, 9 Drawing Sheets

FLUID SPRAY GUN

BACKGROUND OF THE INVENTION

The present invention relates in general to controlled fluid delivery systems. More particularly, the invention relates to an improved paint spray gun device.

Hand-held spray devices are used in a variety of utility applications for the delivery of material, such as fine solid particulate material, and fluid or liquid substances, such as paints, liquid chemicals and the like that are capable of being atomized and directed through a spray emission control nozzle onto a given target area. Spray guns used in spray painting systems atomize the liquid paint by means of atomizing air which enters the nozzle area via a chamber which surrounds a fluid nozzle. The paint is atomized by the accelerating burst of this air as it exits the nozzle via a central aperture located at the end of the chamber. The initial conventional pattern of the atomized liquid and air mixture is in cross section a circle as long as the exit aperture is circular.

When the compressed air source for a spray painting apparatus utilizes a high volume, low pressure compressor, it is conventional for the exit nozzle on the spray painting gun to have a central aperture which is considerably larger than the circumscribed liquid nozzle. The large amount of air utilized in a conventional spray paint nozzle is due to the relative size of the central aperture compared to that of the liquid nozzle.

It is now known that the spray pattern of a paint spray gun can be adjusted via the use of an adjustment screw for the needle. One known such design is illustrated in U.S. Pat. No. 4,915,303 which is owned by the assignee of the instant application. That patent is incorporated herein by reference in its entirety.

Such a device customarily comprises a hand-held spray gun unit having a pistol grip or handle and a barrel. An operator uses the handle both to hold the spray gun and to operate a trigger mechanism for controlling the emission of a fluid, such as paint, from a nozzle element positioned in the barrel. The spray pattern delivered by the nozzle element is controlled by a rotatable wheel mounted at the rear of the spray gun unit. Located beneath the nozzle element is a storage container attachment fitting through which a storage container or tank, usually in the form of a bottle, is mounted on the spray gun. The tank is usually pressurized and its contents are drawn into an internal delivery line within the spray gun unit and ported to the nozzle element. To pressurize the contents of the storage container, its top or lid is fitted with a pressure port to which a fluid line is attached in order to establish a prescribed "head" pressure above the material held in the container. Mounted on the gun is a pressure regulator valve having an inlet port which is coupled to the air inlet line and an outlet port which is coupled to the main pressure inlet port in the barrel of the gun. This valve allows the operator to set the spray nozzle emission control pressure. For a typical industrial paint spraying application, such as in an automobile body repair facility, the nozzle pressure may be on the order of anywhere from 25 to 100 psi. In contrast, the head pressure in the storage container is considerably lower than the main supply pressure and may be on the order of 5 to 10 psi.

On a conventional high volume, low pressure conversion gun, i.e. a gun which uses a high pressure air supply (from 10 to 125 psig) but sprays fluid at a low pressure (i.e. under 10 psig), closing the fan aperture in the gun increases the atomizing pressure or "head" pressure in the paint container dramatically if the inlet pressure is not reduced. For pressure feed systems, this can be a problem because the fluid container cups can be overpressurized. Conceivably, the bottom of the container cup can be blown out. Such a pressure increase or pressure spike is also disadvantageous from the standpoint that the coating compositions sprayed by the gun will not flow evenly. There also may be too much air mixed in with the coating composition which is to be sprayed, resulting in difficulties in the spraying process.

Another patent which discloses a conventional paint spray nozzle is U.S. Pat. No. 4,948,053 which is assigned to the assignee of the instant application. That patent is also incorporated herein by reference in its entirety.

Accordingly, it has been considered desirable to develop a new and improved fluid spray gun which would overcome the foregoing difficulties and others while providing better and more advantageous overall results.

SUMMARY OF THE INVENTION

One advantage of the present invention is the provision of a spray gun for use with air atomizable liquids.

Preferably the spray gun comprises a gun body. A plenum is defined in the gun body and a supply air aperture is located in the plenum for feeding supply air into the plenum. An aperture is located in the plenum for directing air flow out of the plenum. A first outlet is defined on a wall of the aperture for directing fan air flow out of the aperture. A second outlet is defined in the plenum for directing atomizing air flow out of the plenum. A valve seat is defined at a proximal end of the aperture and a valve element selectively seats on the valve seat to prevent air flow into the aperture. A fluid nozzle is in communication with the first and second outlets.

Preferably, an air cap is selectively secured to the gun handle with the air cap communicating with the first outlet and allowing an outflow of air from the first outlet. A retaining ring selectively secures the air cap to the gun body. The gun body further comprises a fluid inlet fitting and an air inlet fitting spaced from the fluid inlet fitting. The air inlet fitting communicates with the air supply aperture.

A third outlet is preferably defined on the wall of the aperture for directing atomizing air flow out of the aperture. The fluid nozzle preferably comprises a nozzle body, a needle tip mounted for reciprocation in the nozzle body, a needle shaft on which the needle tip is mounted, a biasing member mounted on the needle shaft and a needle adjusting member mounted on the needle shaft adjacent the biasing member. A trigger is preferably pivotally secured to the gun body and is operably connected to the fluid nozzle. The trigger preferably comprises a spring valve, a valve seat located in the gun body for cooperating with the spring valve, a valve stem on which the spring valve is mounted, a biasing member mounted on the valve stem and a valve cap mounted on the valve stem and located adjacent the biasing member. The spray gun preferably comprises a fan air knob mounted on the gun body and a valve stem connected at a first end to the fan air knob and connected at a second end to the valve element.

One advantage of the present invention is the provision of a new and improved hand-held spray gun.

Another advantage of the present invention is the provision of a fluid spray gun in which the atomizing air pressure in the gun will not be significantly increased if the fan air opening is closed and the inlet pressure is not reduced.

Still another advantage of the present invention is the provision of a fluid spray gun design in which one of two atomizing air inlet apertures is closed off when the fan air inlet is closed.

Yet another advantage of the present invention is the provision of a fluid spray gun having a fan air valving assembly which selectively closes off the fan air aperture and one atomizing air aperture from a plenum when a fan air valve is closed but leaves open another atomizing air aperture to allow air flow out of the plenum.

Other benefits and advantages of the present invention will become apparent to those of average skill in the art upon a reading and understanding of the following detailed description.

BRIEF DESCRIPTION OF THE DRAWINGS

The invention may take physical form in certain parts and arrangements of parts, the preferred embodiments of which will be described in detail in this specification and illustrated in the accompanying drawings which form a part hereof and wherein.

DETAILED DESCRIPTION OF THE PREFERRED EMBODIMENTS

The present invention relates to a hand-held spray gun A (FIG. 7) that is used to dispense a fluid. The spray gun can be used to dispense a paint onto a surface for coating that surface. More specifically, the spray gun can be a high volume, low pressure (HVLP) conversion gun used with air atomizable paints fed from a pressurized paint holding cup. However, it should be appreciated that the invention disclosed herein can also be used in a high volume, low pressure gravity fed spray gun.

Figure 1:
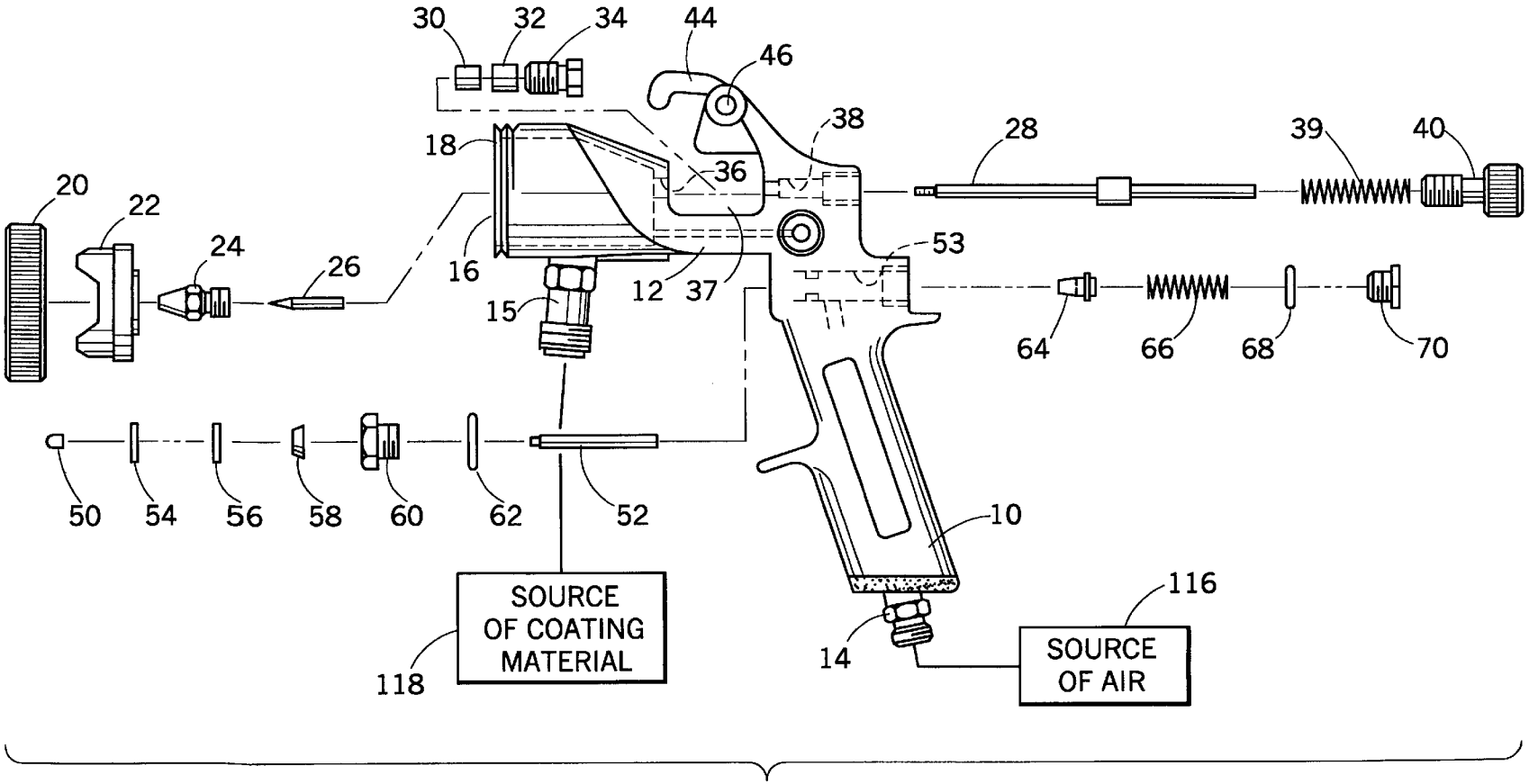
FIG. 1 is an exploded side elevational view of the spray gun according to a first preferred embodiment of the present invention.

With reference now to FIG. 1, the spray gun A includes a gun handle 10 and a gun barrel 12 which are preferably integral. The body of the spray gun can be made from a suitable conventional material, such as a metal. In the preferred embodiment, the body is made from a cast aluminum material. However, the body can also be made from a conventional plastic material, if so desired. An air fitting 14 is connected to the gun handle and delivers pressurized air into the gun. A fluid fitting 15 is connected to the barrel and delivers a pressurized fluid into the barrel. An outlet opening 16 is defined at a front end of the barrel. Adjacent the outlet opening, an outer periphery of the barrel has a threaded portion 18.

A retaining ring 20 can be selectively threaded onto the threaded portion 18 of the barrel. An air cap 22 is preferably mounted in the opening 16 and is held in place by the retaining ring 20. A fluid nozzle 24 is disposed in the outlet opening 16 beneath the air cap 22. A needle tip 26 is mounted to a needle shaft 28 which reciprocates in the nozzle 24 to control flow therethrough. The needle shaft extends through a fluid packing 30, a spacer 32 and a packing nut 34. These items, which are located in a longitudinally extending bore 36 of the gun barrel 12, prevent the fluid from flowing rearward in the nozzle. The bore 36 communicates with the outlet opening 16 and is located in a front portion of the barrel. The bore 36 terminates in a cutout 37 in the barrel. Axially aligned with the bore 36 is a second bore 38 provided in a second portion of the barrel behind the cutout. The needle shaft 28 extends into the second bore 38 in the barrel. Mounted in the second bore is a needle return spring 39 and a needle adjusting screw 40. The needle adjusting screw is threadedly mounted in the opening 38. Similarly, the packing nut 34 is threadedly mounted in the bore 36.

Extending upwardly from the second portion of the barrel is a hook 44. The hook can be used to suspend the gun 10 from a suitable mounting means. Located inwardly from a distal end of the hook is an aperture 46 extending transversely through the hook.

Figure 7:
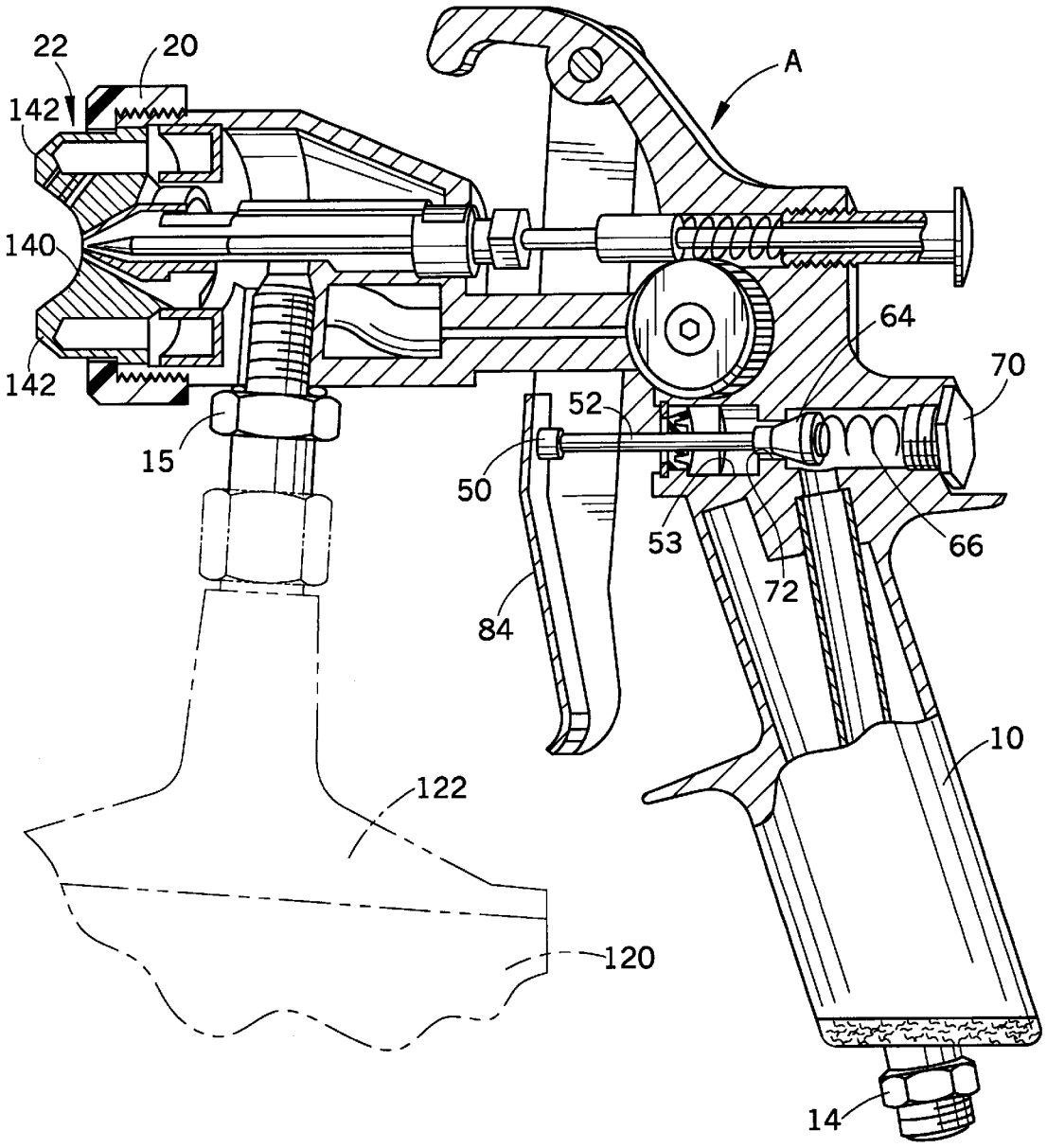
FIG. 7 is a cross-sectional view of the spray gun of FIG. 1 in an assembled condition.

An air valve control assembly is mounted in the handle 10 of the gun A. More particularly, a valve rod cap 50 is mounted on a distal end of a valve stem 52 which is housed in a bore 53 extending longitudinally in the gun handle 10. Also housed in the aperture are a snap ring 54, a spacer 56, a lip seal 58, a seal housing 60 and an O-ring 62. Further mounted in the aperture is a valve seat 64, a spring 66, an O-ring 68 and a valve cap 70. With reference to FIG. 7, the valve seat 64 reciprocates in relation to an annular shoulder 72 defined in the bore 53 to control the flow of air through the bore.

Figures 2A, 2B:
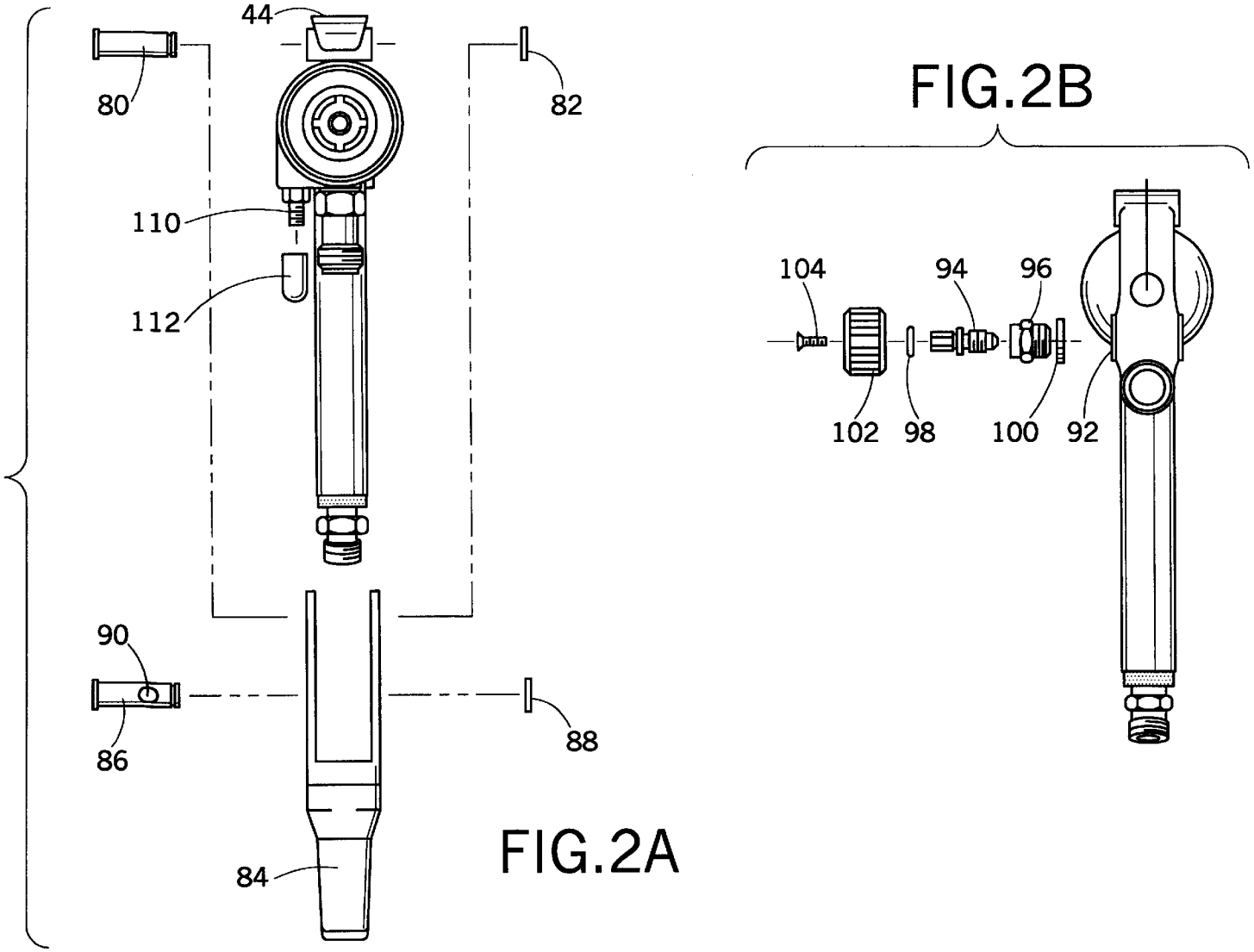
FIG. 2A is an exploded front elevational view of the spray gun of FIG. 1.
FIG. 2B is an exploded rear elevational view of the spray gun of FIG. 1.

With reference now to FIG. 2A, a trigger pivot pin 80 is mounted in the aperture 46 of the hook 44 illustrated in FIG. 1. Mounted on a distal end of the pivot pin 80 is an E-clip 82 to hold the pivot pin in place. The pivot pin is used to pivotally mount a trigger 84 on the gun A. Extending through a pair of spaced aligned apertures in the legs of the trigger is a trigger pin 86. The trigger pin is held in place by an E-clip 88 mounted at a distal end of the pin. An aperture 90 extends transversely through the trigger pin 86. The valve stem 28 is sized to extend through the trigger pin aperture 90.

With reference now to FIG. 2B, an aperture 92 extends transversely into the gun handle 10. Mounted in the aperture is a valve stem 94. The valve stem rotates in a fan air fitting 96 which is mounted, via suitable mating threads, in the aperture 92. An O-ring 98 is disposed on a proximal end of the valve stem 94 and an E-clip 100 is mounted at a proximal end of the valve stem 94. The purpose of the E-clip 100 is to act as a stop for the valve stem 94 thereby to prevent the valve stem from being threaded out of the fan air fitting 96. Located on the proximal end of the valve stem is a fan air knob 102. The knob can be held in place by a fastener 104 extending into the valve stem.

With reference again to FIG. 2A, an air pressure stem 110 is located on the barrel adjacent the fluid fitting 15. When not in use, a stem cap 112 can close the air pressure stem 110.

With reference again to FIG. 1, the air fitting 14 communicates with a suitable conventional source of air 116. Such an air supply has a pressure of anywhere from 10 to 125 psig. The fluid fitting 15 communicates with a suitable conventional source of coating material 118, such as paint. As shown in FIG. 7, the source of paint can be, e.g., a one quart pressure cup 120 of conventional design. Such a cup is normally made from a suitable spun metal material and has a cap 122 which is threaded onto the fluid fitting 15.

Figure 5:
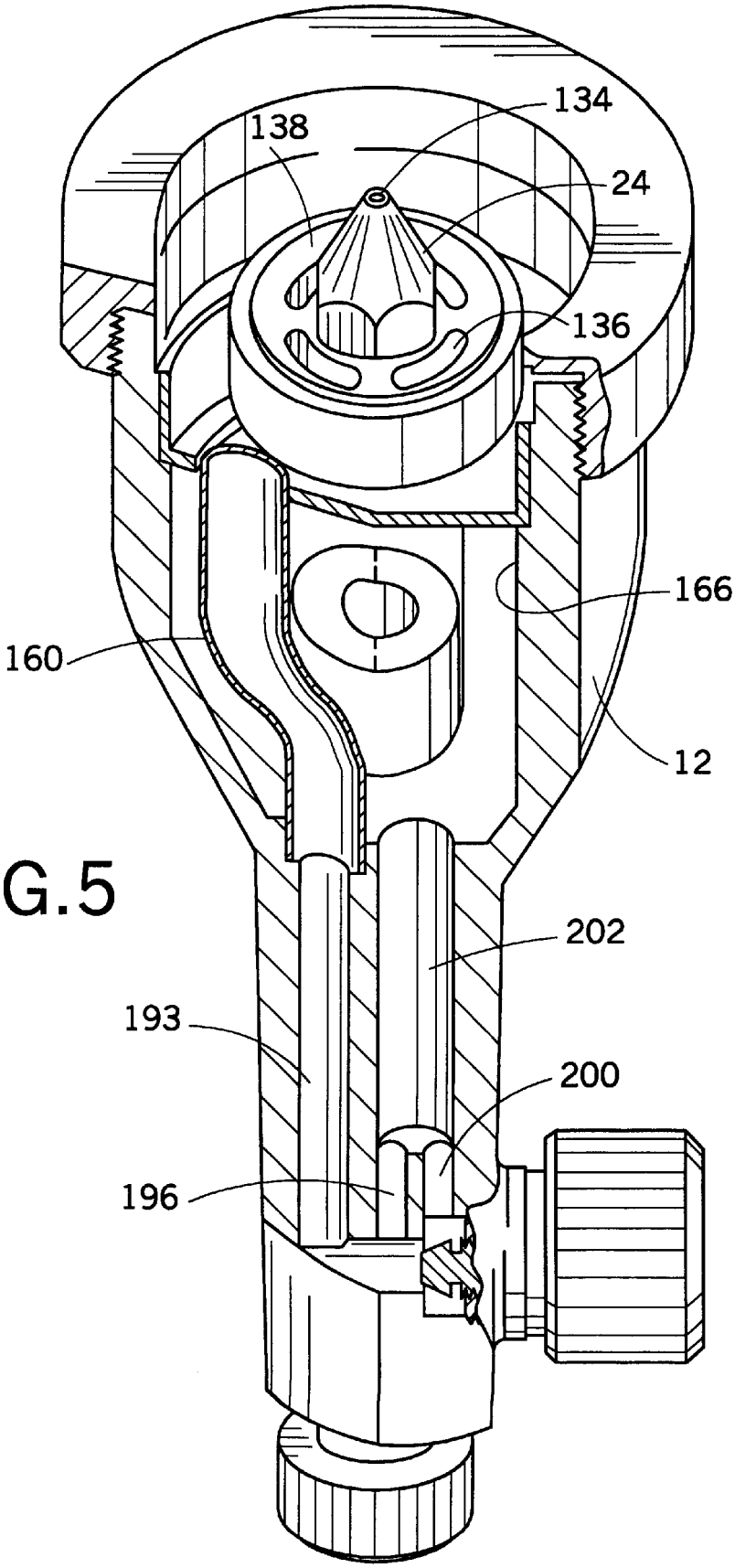
FIG. 5 is an enlarged perspective view of a barrel portion of the spray gun of FIG. 1 with parts thereof broken away and in cross-section for clarity.
Figure 6:
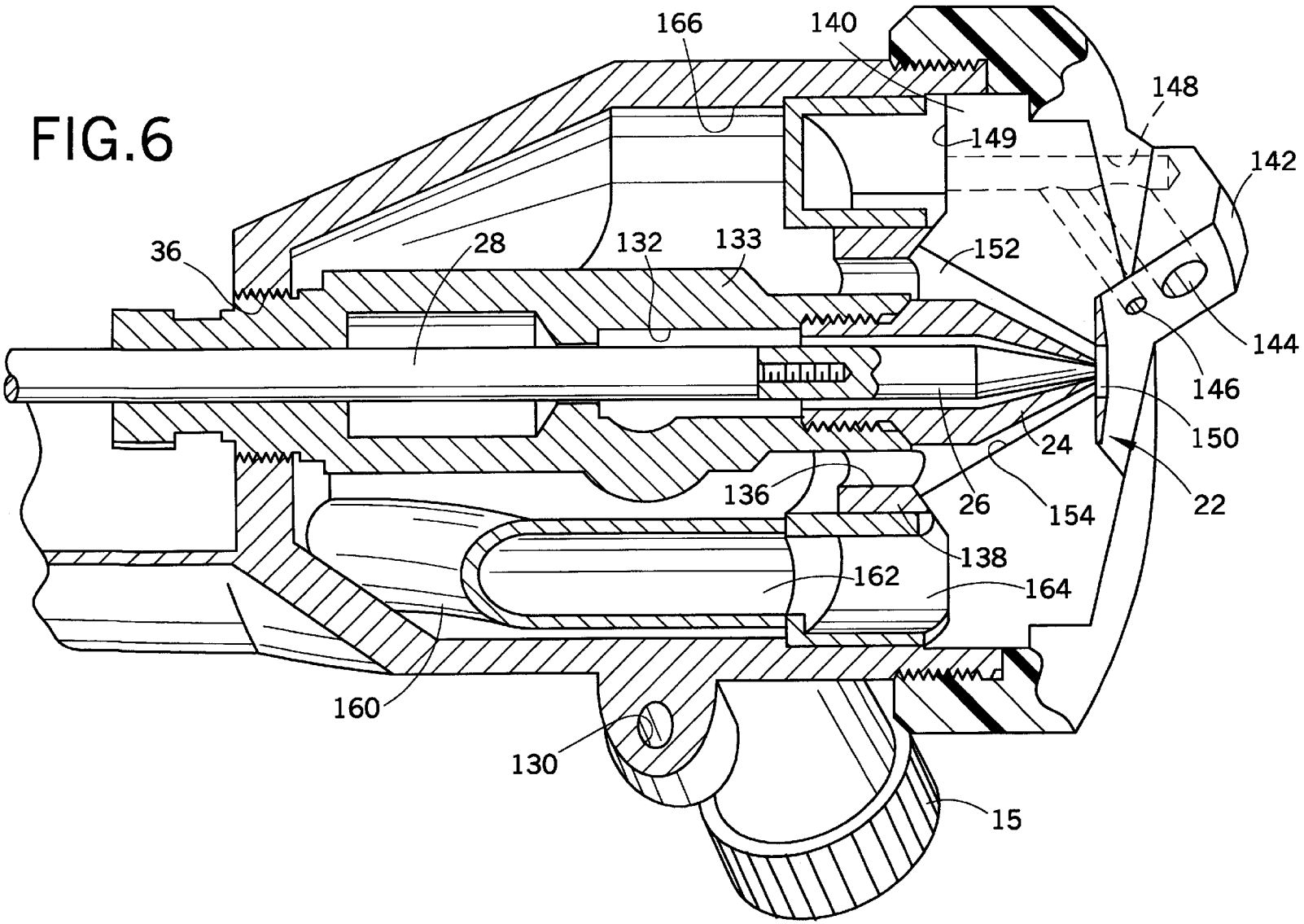
FIG. 6 is an enlarged side elevational view of the barrel portion of the spray gun of FIG. 1 in cross-section.

With reference now to FIG. 6, an atomizing air bore 130 defined in the barrel 12 communicates with the air pressure stem 110 and allows pressurized air to be delivered to the paint cup to pressurize the paint therein. The needle tip 26 and needle shaft 28 reciprocate in a bore 132 of a nozzle body 133 to which the fluid nozzle 24 is threadedly secured. The nozzle body 133 is secured in the barrel 12 and communicates with the fluid fitting 15. Fluid is thus delivered into the fluid nozzle bore 132. The fluid nozzle 24 has an outlet 134 which is illustrated in FIG. 5. Also defined in the barrel around the fluid nozzle 24 are a plurality of atomizing air outlets 136. Preferably four such outlets are provided in a toroidal atomizer body 138. The toroidal atomizer body encircles the nozzle body 133 as is evident from FIG. 6.

As shown in FIG. 7, the air cap 22 is conventional and comprises an air cap body 140 having a pair of spaced oppositely extending ears 142. With reference again to FIG. 6, each ear includes a respective first fan aperture 144 and, spaced therefrom, a second fan aperture 146 of significantly smaller size. A fan air bore 148 communicates the apertures 144 and 146 with a rear surface 149 of the air cap body 140. A centrally positioned aperture 150 is provided in the air cap body 140 coaxial with the nozzle 24. The air cap body 140 can spin in the gun barrel 12 if the retaining ring 20 is not tightened down against the gun barrel. If the retaining ring is tightened down, however, the air cap is stationary.

The barrel bore 36 is aligned with the fluid nozzle 24 and the toroidal atomizer body 138 in order to allow air to flow out of the atomizing air outlets 136 and into an annulus 152 defined between an outer periphery of the fluid nozzle 24 and an angled surface 154 of the air cap body which leads to the central opening 150 thereof. With this arrangement, atomizing air flows out of the air outlet 136 and through the annulus 152 and out the central opening 150. At the same time, fan air flows through the bore 148 and out through the first and second fan air apertures 144 and 146. The fan air is communicated to the bore 148 via a fan air conduit extension 160. A front opening 162 of the fan air conduit communicates with a toroidal fan air chamber 164 which is press fitted in place in a hollow interior 166 of the gun barrel 12 around the atomizer body 138. The fan air chamber 164 in turn communicates with the two fan air bores 148 in the air cap body. It is apparent from FIG. 6 that the fan air chamber 164, the atomizer body 38 and the nozzle body 133 cooperate with each other so as to rigidly hold these three elements in the hollow interior 166.

Figure 4:
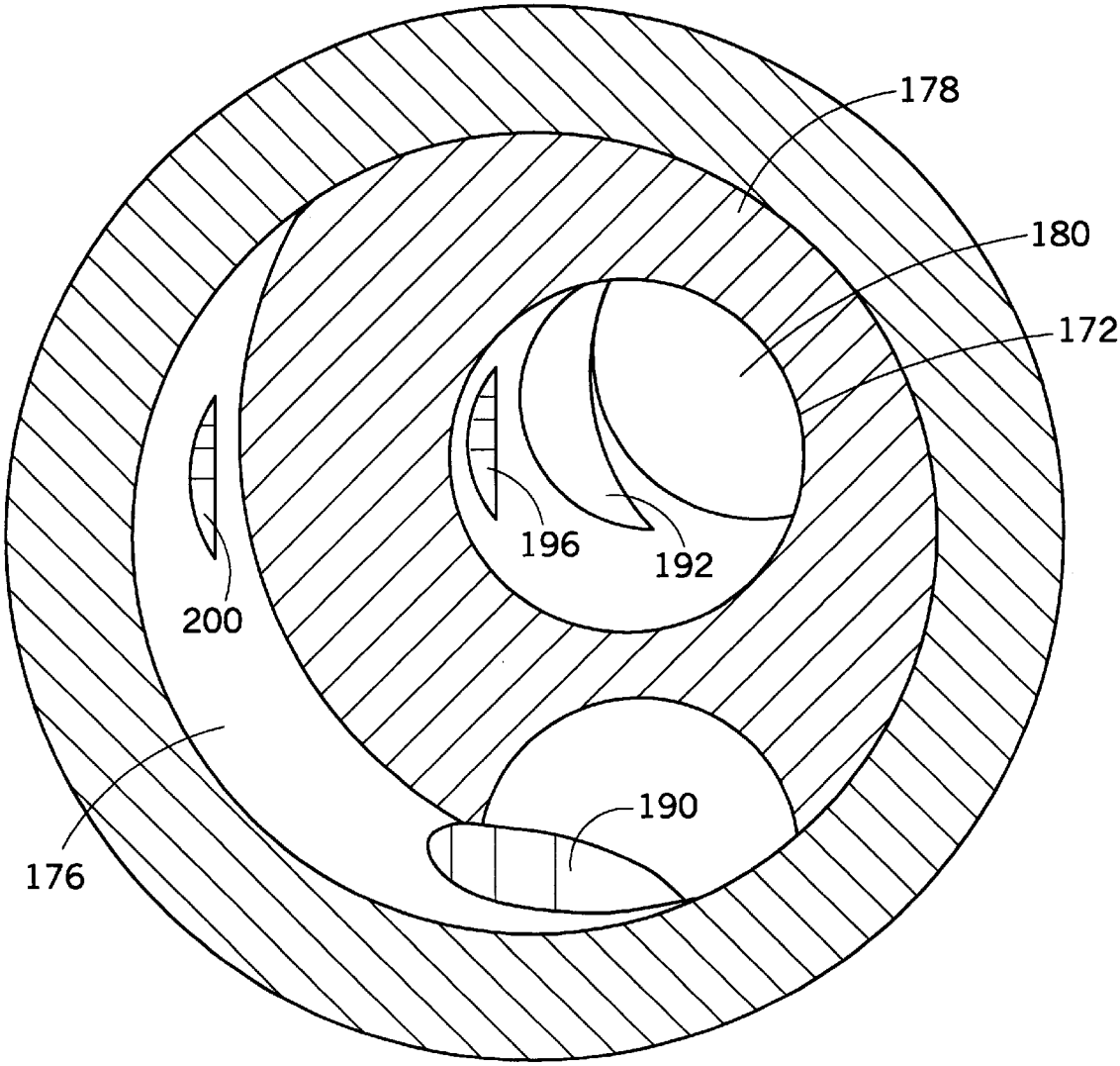
FIG. 4 is a greatly enlarged cross-sectional view of a plenum in the barrel of the spray gun of FIG. 3.
Figure 8:
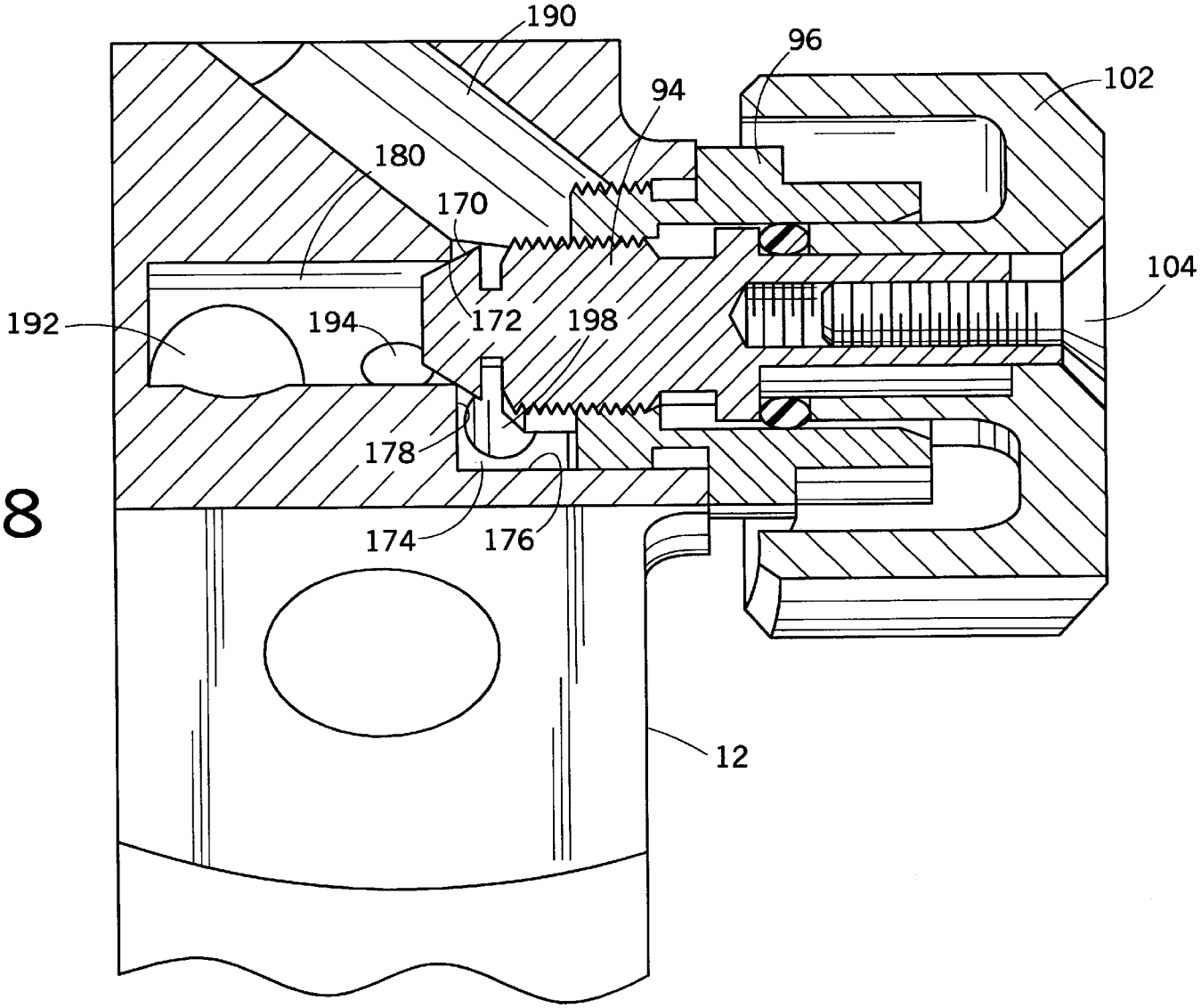
FIG. 8 is an enlarged cross-sectional view of a section of the barrel portion of the spray gun of FIG. 1.

With reference now to FIG. 8, the valve stem 94 of the fan air control mechanism includes a sealing surface 170 which selectively seals against a valve seat 172 that is located at one end of a plenum 174 defined in the gun barrel 12. The plenum is defined by a toroidal side wall 176 and an end wall 178 located in the gun barrel 12. An aperture 180 leads away from the plenum 174. The aperture is surrounded by the valve seat 172 which can be best seen in FIG. 4. A supply air inlet 190 extends at an angle into the plenum such that the aperture 190 is defined both along the plenum side wall 176 and end wall 178. The supply air aperture 190 comes in at an angle to maximize the air hole size and increase the flow of air in cubic feet per minute through the plenum.

Figure 3:
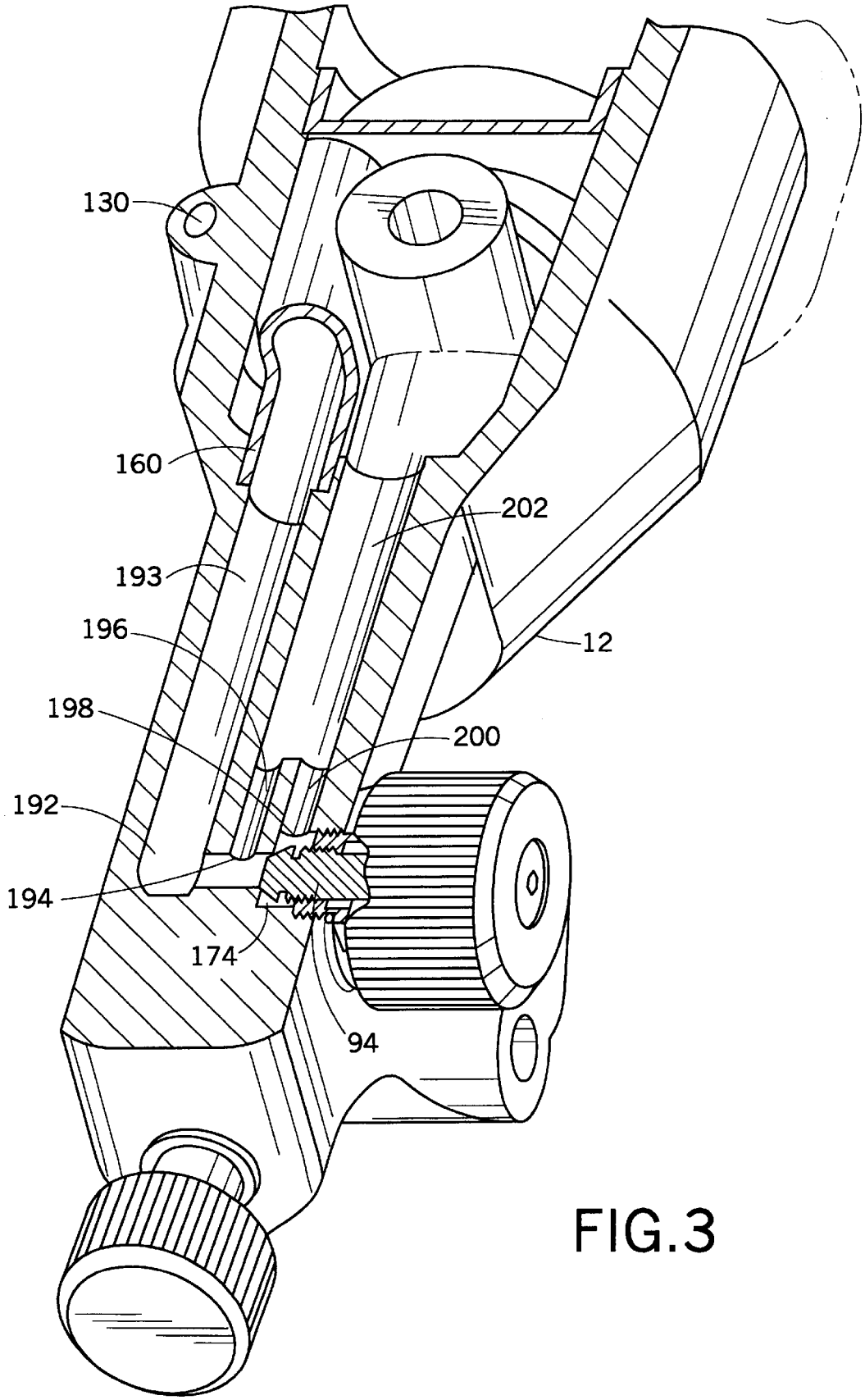
FIG. 3 is an enlarged cross-sectional view of a barrel portion of the spray gun of FIG. 1.

When the valve sealing surface 170 is seated on the valve seat 172, the aperture 180 is isolated from the supply air inlet 190. In this position of the valve stem 94, as illustrated in FIG. 3, air does not flow into an inlet 192 of a fan air conduit 193 which communicates with the fan air conduit extension 160. In addition, fan air does not flow into an inlet 194 of a secondary atomizing air conduit 196. However, air does flow into an inlet 198 of a primary atomizing air conduit 200. As illustrated in FIG. 5, the primary atomizing air conduit 200 and the secondary atomizing air conduit 196 are small diameter bores which communicate with a larger diameter master atomizing air conduit 202 defined in the gun barrel 12. It is apparent that the conduits 193 and 202 are parallel to and spaced from each other and are both defined in the gun barrel 12. As shown in FIG. 5, a distal end of the master atomizing air conduit 202 in turn communicates with the hollow interior 166 of the gun barrel to allow air to flow to the several atomizing air outlets 136.

With reference again to FIG. 7, when the trigger 84 is pulled back, the rear face of the trigger will contact the valve rod cap 50 and hence the valve stem 52 thereby pushing the valve stem back against the bias of the spring 66 and opening the air flow path for pressurized air to flow through the gun handle and, via the supply air inlet 190, into the plenum 174.

It should also be appreciated from FIG. 8 that once the valve stem 94 is threaded in the fan air fitting 96, the valve element can be selectively advanced or retracted a desired amount so as to constrict the air flow path into the aperture 180 a desired amount. The construction can limit air flow into the outlets 192 and 194. This construction allows a careful metering of air flow into these two outlets as desired by the operator of the gun.

With the valving structure and arrangement of conduits illustrated in FIGS. 3–5 and 8, when the fan air is shut off, the atomizing air pressure does not spike up leading to the problems discussed earlier. It should be appreciated that while air could conceivably flow from the primary atomizing air conduit 200 into the master air atomizing conduit 202 and then backwards through the secondary air atomizing conduit 196, through the inlet 194 and into the aperture 180 and from there into the fan air conduit 193 which, in turn, communicates with the fan air conduit extension 160, such flow does not in reality take place due to the pressure drops involved in the serpentine nature of such a proposed flow path. It has been determined that when the valve stem 94 is seated on the valve seat 172, substantially no air flows through the fan air conduit 193, the fan air conduit extension 160, the toroidal fan air chamber 164 and out through the fan air apertures 144 and 146.

Figure 9:
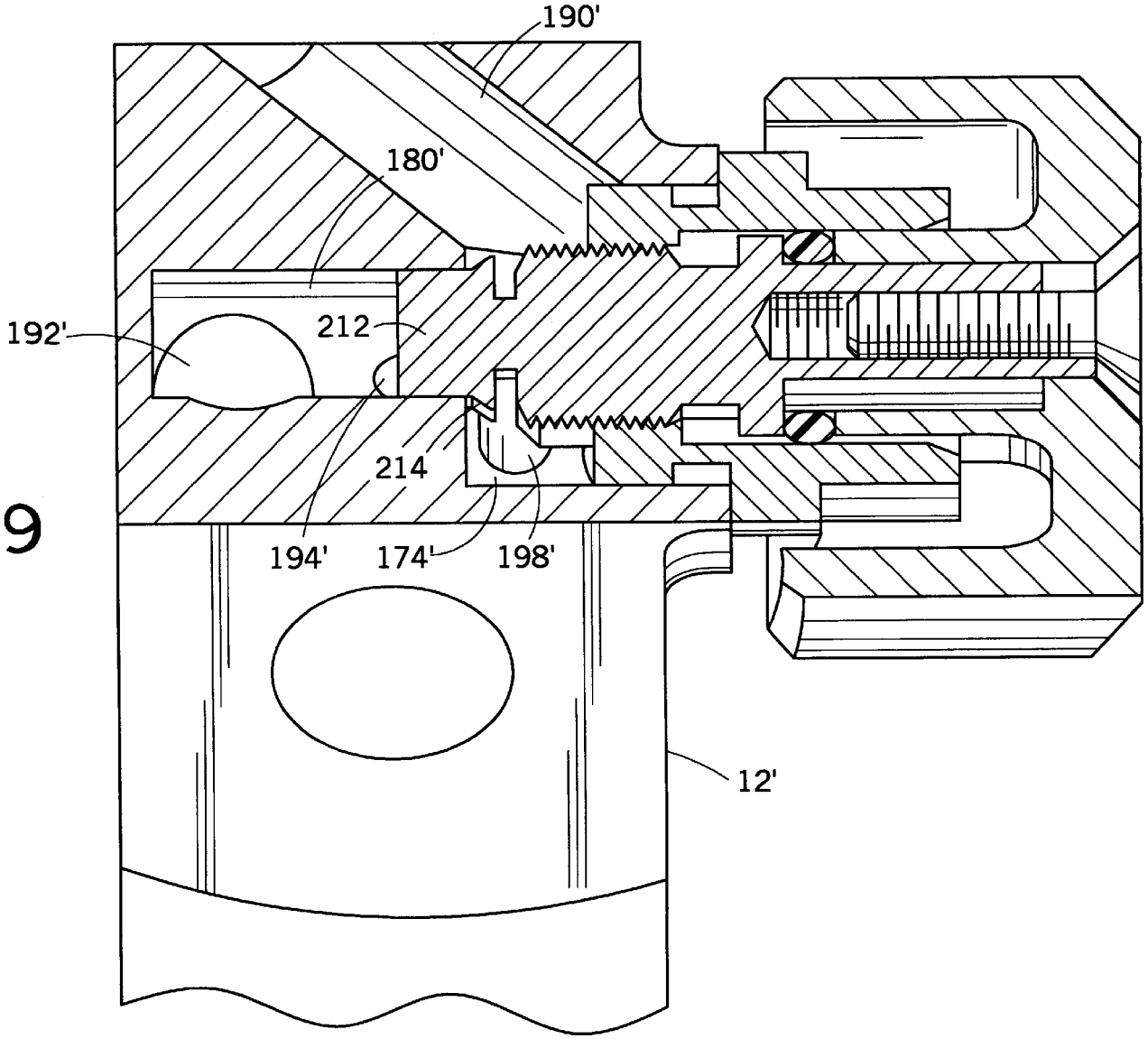
FIG. 9 is a cross-sectional view of a section of a barrel portion of a spray gun according to a second preferred embodiment of the present invention.

With reference now to FIG. 9, a second embodiment of a valve assembly is there illustrated. In this embodiment, like components are identified by like numerals with a primed (') suffix and new components are identified by new numerals. A gun barrel 12' includes a plenum 174' having therein an aperture 180'. Located in a wall of the aperture is an outlet 192' of a fan air conduit. Also located in a wall of the aperture 180' in a manner spaced from the outlet 192' is an outlet 194' of a secondary atomizing air conduit. Located in a wall of the plenum is an outlet 198' of a primary atomizing air conduit. Extending into the plenum 174' is a supply air inlet 190'. In this embodiment, a valve stem 210 is provided with an elongated skirt 212. The skirt seals over the outlet 194' when the valve sealing surface 214 is seated against a valve seat 172' defined at the intersection of the aperture 180' and the plenum 174'. With this arrangement, the skirt 212 extends over the outlet 194' to prevent a flow of air back into the aperture 180'. Therefore, air cannot then flow out through outlet 192'.

The invention has been described with reference to the preferred embodiments. Obviously, modifications and alterations will occur to others upon the reading and understanding of this specification. It is intended to include all such modifications and alterations insofar as they come within the scope of the appended claims and the equivalents thereof.

What is claimed:

1. A spray gun for use with air atomizable liquids, comprising:

a gun body;

a plenum defined in said gun body;

a supply air inlet in said plenum for feeding supply air into said plenum;

a bore in said plenum for directing air flow out of said plenum;

a first inlet defined on a wall of said bore for directing air flow out of said bore to a central opening of said gun body;

a second inlet in said plenum for directing pair flow out of said plenum to said central opening of said gun body;

a valve seat defined at a proximal end of said bore;

a valve element which selectively seats on said valve seat to prevent air flow into said bore; and, a fluid nozzle in communication with said first and second outlets.

2. The spray gun of claim 1 further comprising an air cap selectively secured to said gun body, said air cap communicating with said first outlet and allowing an outflow of fan air from said first outlet.

3. The spray gun of claim 2 further comprising a retaining ring which secures said air cap to said gun body.

4. The spray gun of claim 1 wherein said gun body further comprises a fluid inlet fitting, and an air inlet fitting spaced from said fluid inlet fitting, said air inlet fitting communicating with said supply air inlet.

5. The spray gun of claim 1 further comprising a third inlet defined on said wall of said bore and spaced from said first inlet for directing air flow out of said bore.

6. The spray gun of claim 1 wherein said fluid nozzle comprises:

a nozzle body;

a needle tip mounted for reciprocation in said nozzle body;

a needle shaft on which said needle tip is mounted;

a biasing member mounted on said needle shaft; and, a needle adjusting member mounted on said needle shaft adjacent said biasing member.

7. The spray gun of claim 1 further comprising a trigger pivotally secured to said gun body and operably connected to said fluid nozzle.

8. The spray gun of claim 7 wherein said trigger comprises:

a spring valve;

a valve seat located in said gun body for cooperating with said spring valve;

a valve stem on which said spring valve is mounted;

a biasing member mounted on said valve stem; and, a valve cap located adjacent said biasing member.

9. The spray gun of claim 1 further comprising a fan air knob mounted for rotation on said gun body;

a valve stem connected at a first end to said fan air knob and connected at a second end to said valve element.

10. A high volume, low pressure spray gun for use with air atomizable liquids, comprising:

a body having a handle and a barrel;

a plenum defined in said gun barrel;

a valve seat defined in said gun barrel and communicating with said plenum;

a supply air inlet communicating with said plenum for feeding supply air into said plenum;

a bore in said plenum for directing air out of said plenum;

a first atomizing air inlet defined in a wall of said bore for directing atomizing air flow out of said bore and to a central opening of said gun body; and a second atomizing air inlet in said plenum for directing atomizing air flow out of said plenum and to said central opening of said gun body, wherein said first inlet is located on one side of said valve seat and said second inlet is located on another side of said valve seat.

11. The spray gun of claim 10 further comprising:

a fan air conduit communicating with said plenum;

an air cap selectively secured to said gun handle, said air cap communicating with said fan air conduit and allowing an outflow of air from said fan air conduit; and, a retaining ring which secures said air cap to said gun barrel.

12. The spray gun of claim 10 wherein said gun body further comprises:

a fluid inlet fitting; and, an air inlet fitting spaced from said fluid inlet fitting, said air inlet fitting communicating with said supply air inlet.

13. The spray gun of claim 10 wherein said fluid nozzle comprises:

a nozzle body;

a needle tip mounted for reciprocation in said nozzle body;

a needle shaft on which said needle tip is mounted;

a biasing member mounted on said needle shaft; and, a needle adjusting member mounted on said needle shaft adjacent said biasing member.

14. The spray gun of claim 10 further comprising a trigger pivotally secured to said gun handle and operably connected to said fluid nozzle.

15. The spray gun of claim 14 wherein said trigger comprises:

a spring valve;

a valve seat located in said gun handle for cooperating with said spray valve;

a valve stem on which said spring valve is mounted;

a biasing member mounted on said valve stem; and, a valve cap located adjacent said biasing member.

16. The spray gun of claim 10 further comprising:

a valve element which selectively seats on said valve seat;

a fan air knob mounted on said gun handle;

a valve stem connected at a first end to said fan air knob and at a second end to said valve element.

17. A high volume, low pressure spray gun for use with air atomizable liquids, comprising:

a gun body having a handle and a barrel;

a plenum defined in said gun barrel;

a valve seat defined in said gun barrel and communicating with said plenum;

a supply air inlet communicating with said plenum for feeding supply air into said plenum;

a bore in said plenum for directing air flow out of said plenum;

a first inlet defined in a wall of said bore for directing fan air flow out of said bore and to an ear of an air cap selectively secured to said gun body;

a second inlet in said wall of said bore for directing atomizing air flow out of said bore and to a central opening of said gun body;

a third inlet in said plenum for directing atomizing air flow out of said plenum and to said central opening of said gun body, wherein said third outlet is located on one side of said valve seat and said second outlet is located on another side of said valve seat; and, a fan air control assembly mounted on said gun handle for regulating a flow of fan air out of said first outlet, said fan air control assembly comprising a valve element which selectively seats on said valve seat to close off communication from said plenum to said bore.

18. The spray gun of claim 17 wherein said fluid nozzle comprises:

a nozzle body;

a needle tip mounted for reciprocation in said nozzle body;

a needle shaft on which said needle tip is mounted;

a biasing member mounted on said needle shaft; and, a needle adjusting member mounted on said needle shaft adjacent said biasing member.

19. The spray gun of claim 17 further comprising a trigger pivotally secured to said gun handle and operably connected to said fluid nozzle.

20. The spray gun of claim 19 wherein said trigger comprises:

a spring valve;

a valve seat located in said gun handle for cooperating with said spring valve;

a valve stem on which said spring valve is mounted;

a biasing member mounted on said valve stem; and, a valve cap located adjacent said biasing member.

21. The spray gun of claim 17 wherein said fan air control assembly comprises:

a fan air knob mounted on said gun handle;

a valve stem connected at a first end to said fan air knob and at a second end to said valve element.

* * * * *